United States Patent [19]

Budoff

[11] 4,044,664

[45] Aug. 30, 1977

[54] SYSTEM FOR THE HANDLING OF SOLID WASTE

[75] Inventor: Hyman Budoff, Akron, Ohio

[73] Assignee: Hybud Equipment Corporation, Akron, Ohio

[21] Appl. No.: 614,357

[22] Filed: Sept. 18, 1975

[51] Int. Cl.[2] ..... B30B 15/18

[52] U.S. Cl. ..... 100/48; 100/53; 100/99; 100/193; 100/215; 100/229 A

[58] Field of Search ..... 100/53, 48, 49, 99, 100/193, 209, 215, 50, 229 A

[56] References Cited

U.S. PATENT DOCUMENTS

| | | | |
|---|---|---|---|
| 3,561,624 | 2/1971 | Thurmond | 100/209 X |
| 3,640,411 | 2/1972 | Anderson | 100/209 X |
| 3,695,175 | 10/1972 | Bausenbach | 100/193 |
| 3,872,784 | 3/1975 | Kaszuba et al. | 100/209 X |

*Primary Examiner*—Billy J. Wilhite

*Attorney, Agent, or Firm*—Mack D. Cook, II

[57] ABSTRACT

A system for the handling of solid waste involving multiple solid waste handling stations. Each station has a hopper unit for receiving waste, a storage unit, and a compactor unit for transferring and compacting the waste. Each station is provided with detector means for detecting a packed storage unit. Adjoining stations are operatively interconnected by station selector means. The station selector means responds to the detector means to deactivate a station having a packed storage unit and to activate an adjoining station having an empty storage unit.

4 Claims, 8 Drawing Figures

FIG. 4
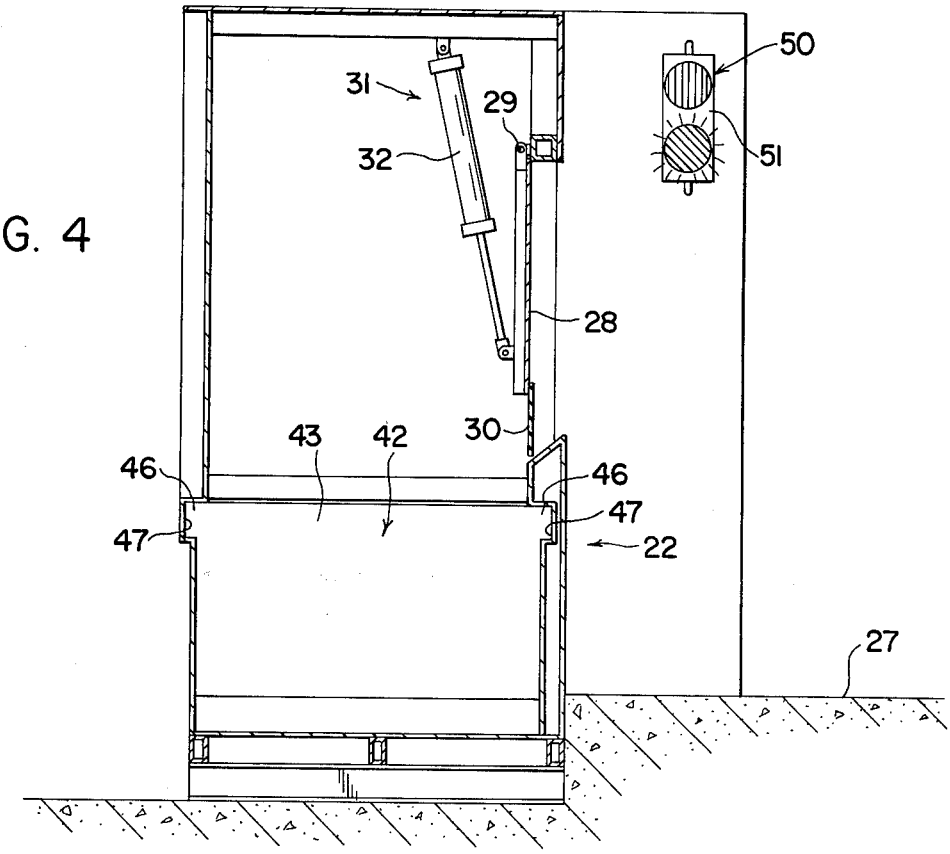
FIG. 5
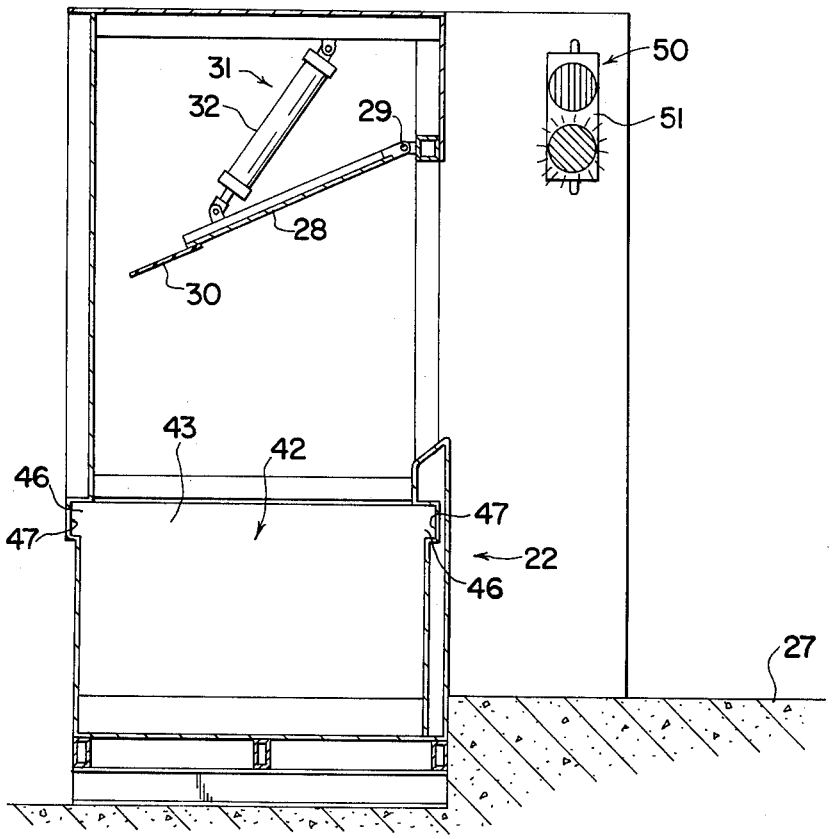
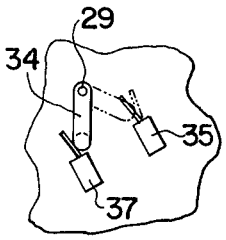
FIG. 6

SYSTEM FOR THE HANDLING OF SOLID WASTE

BACKGROUND OF THE INVENTION

The invention relates to a system for the handling of solid waste involving multiple solid waste handling stations.

Systems for receiving, transferring and compacting solid waste are not new. It is well known to deposit waste in a hopper, and to activate a ram to transfer the waste to, and compact the waste in, a storage container for subsequent disposal.

However, when the storage container is filled or packed, additional waste added to known prior art systems merely accumulates, eventually overflowing. The results are unsightly littering, unpleasant odors or stench, the attraction of rodents and undesirable insects, and the creation of a health hazard.

Also, known prior art systems are inoperable for the period during which a packed storage container is being emptied and returned; or being exchanged.

Furthermore, such systems having reciprocating rams present dangers, particularly to small children.

It has been found that a system according to the invention is capable of continual, uninterrupted operation. Problems attendant with waste overflow are avoided. The inconvenience associated with system shutdown for emptying or exchanging a packed container is nonexistent.

It has further been found that a system according to the invention is safe to operate and virtually childproof.

SUMMARY OF THE INVENTION

The object of the invention is to provide an improved system for the handling of solid waste involving multiple and operatively interconnected stations.

It is a further object of the invention to provide for automatic deactivation of a station having a packed storage unit, and activation of an adjoining station having an empty storage unit.

Still further, it is an object of the invention to provide a solid waste handling system capable of continual, uninterrupted operation, and which is safe to operate.

These and other objects of the invention, and the advantages thereof, will be apparent in view of the description of the various embodiments thereof as set forth below.

In general, a solid waste handling system according to the invention has multiple and operatively interconnected stations. Each station has a hopper unit for receiving waste, a storage unit, and a compactor unit for transferring waste to, and compacting waste in, a storage unit.

Each compactor unit has a detector means for detecting a packed storage unit. Station selector means operatively interconnect adjoining stations. The selector means responds to the detector means to deactivate a station having a packed storage unit, and to activate an adjoining station having an empty storage unit.

In one embodiment, the system is fully automatic, being triggered by vehicle arrival and departure, and having transmitting means to signal the need for emptying a packed storage unit.

DESCRIPTION OF THE DRAWINGS

FIG. 4 is another sectional view, taken substantially as indicated along line 4—4 of FIG. 2;

FIG. 5 is a view similar to FIG. 4, showing a hopper unit in an open and waste-receivable condition;

FIG. 6 is an isolated sectional view, taken substantially as indicated along line 6—6 of FIG. 3;

DETAILED DESCRIPTION OF THE INVENTION

Figure 1:
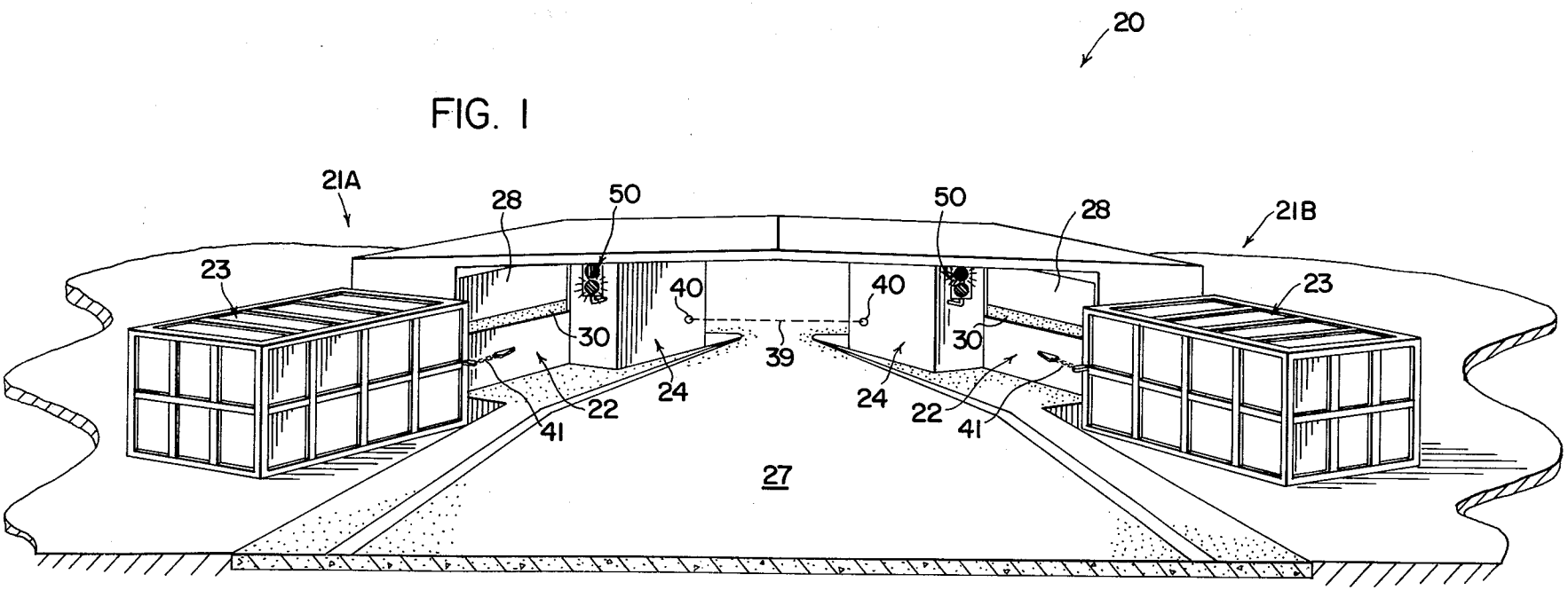
FIG. 1 is a front perspective view of a dual-station system for the handling of solid waste according to the invention.

According to the invention, a solid waste handling system, indicated generally by the numeral 20, has multiple stations, indicated generally by the numeral 21. Each station 21 has a hopper unit, indicated generally by the numeral 22, a storage unit, indicated generally by the numeral 23, and a compactor unit, indicated generally by the numeral 24.

Each compactor unit 24 has a detector means, indicated generally by the numeral 25. Adjoining stations 21 are operatively interconnected by a station selector means, indicated generally by the numeral 26.

As shown in FIG. 1, a system 20 consists of two or more stations 21. The system 20 may be manually operated, but in the preferred embodiment is a fully automatic, drive-through system, triggered by vehicle arrival and departure. The stations 21 may be arranged linearly, but for convenience are preferably arranged in parallel pairs, symmetrical about a common access road 27. When referred to individually, the left-hand station will be designated 21A, and the right-hand station 21B.

The units of each individual station 21 are linearly arranged. A medial hopper unit 22 is a box-like receptacle, the upper portion of which is open or openable for the deposit of solid waste. The hopper unit 22 is open at opposed ends to communicate with terminal storage and compactor units, 23 and 24 respectively.

A hopper unit 22 may be a passive mechanical structure, the sole function of which is to receive waste, as described below as an alternative embodiment. Preferably, a hopper unit 22 is an active and participating link in a waste handling station 21, oriented toward convenience and safety.

With specific reference to FIGS. 4 and 5, the upper portion of the hopper unit 22 is normally closed by a door 28 pivotally mounted or hinged at one edge by a shaft 29 and having secured thereto at the opposite or free edge a yieldable flap 30. For safety reasons, the door 28 is hinged at the top and adapted to open upwardly and within the hopper unit 22 by a door drive means 31, for example a hydraulic cylinder 32, actuated by a suitable hopper control means 33. The flap 30 is a safety precaution, preventing personal injury upon closing of the door 28. The flap 30 also serves to assure that an overloaded hopper unit 22 will not prevent the door 28 from closing.

As illustrated in FIG. 6, a projection 34, which may be a generally "L-shaped" finger, extends outwardly from one end of the shaft 29. As the door 28 swings open and closed, the shaft 29 rotates back and forth, causing the finger 34 to oscillate between a down position when the door is closed and an upper position when the door is open.

As the door 28 opens, the finger 34 moves upwardly into engagement with an upper limit switch 35, operatively connected with the hopper control means 33, and positioned so as to stop the door 28 in a predetermined open position. A check valve 36 prevents accidental closing of the door 28.

Similarly, as the door closes, the finger 34 moves downwardly into engagement with a lower limit switch 37, also operatively connected with the hopper control means 33, and positioned so as to stop the door 28 in a predetermined closed position.

The hopper control means 33, which triggers the initial opening and closing movement of the door 28, may be manual or automatic, and manual operational controls may be provided as a stand-by in the event of a failure in the automatic operational controls.

In the preferred embodiment, the hopper control means 33 operates automatically in response to a sensor means, indicated generally by the numeral 38. The sensor means 38 may be any device capable of detecting the presence or absence of a vehicle or other object adjacent a door 28 in response to weight, signal interruption, or otherwise. For reasons of installation simplicity and low maintenance requirements, an ultrasonic sensor, marketed under the registered trademark Sonac, has been chosen for use in the preferred embodiment.

Figure 7:
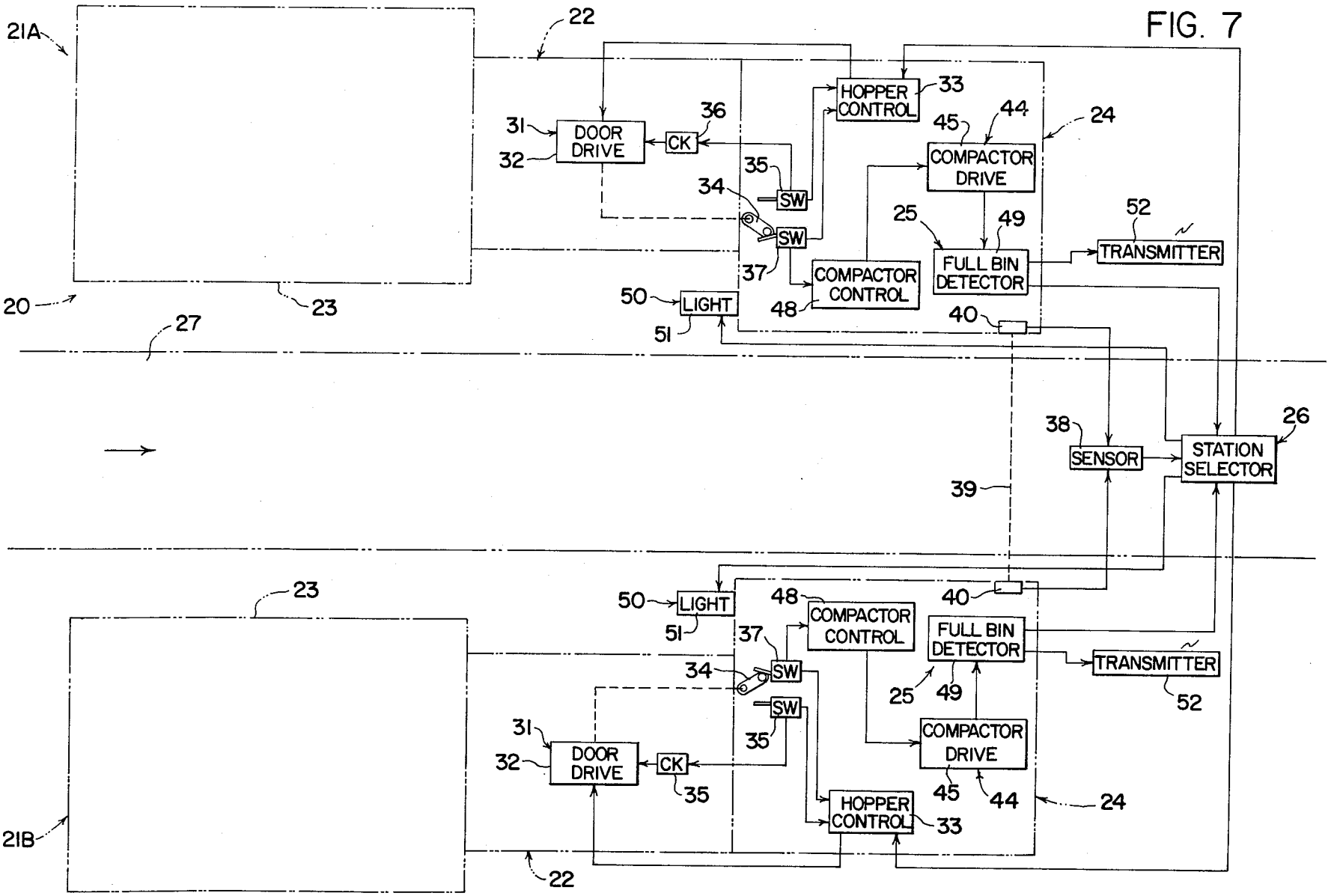
FIG. 7 is a schematic operational diagram of the system of FIG. 1.

Referring to FIGS. 1 and 7, an ultrasonic signal 39, indicated by a broken line, is generated between the terminals 40 of the sensor means 38. The hopper control means 33 is responsively connected to the sensor means 38 by suitable circuitry, such that the hopper control means 33 is alternatively actuated to open and close the door 28 upon interruption and restoration, respectively, of the signal 39.

The response of the hopper control means 33 to the sensor means 38 may be time-delayed by conventional means to require signal interruption for a predetermined time so as to avoid unnecessary actuation by a mere passer-by.

A hopper unit 22 is positioned intermediate a storage unit 23 and a compactor unit 24. A storage unit 23 is a removable bin or container for accumulating waste, and may be of the type described in U.S. Pat. No. 3,897,882. The storage unit 23 has an opening in one end thereof corresponding with an open end of a hopper unit 22, to receive waste ejected therefrom. The storage unit 23 is secured to the hopper unit 22 by a suitable fastening means 41, capable of withstanding forces generated by the compacting operation.

Figure 2:
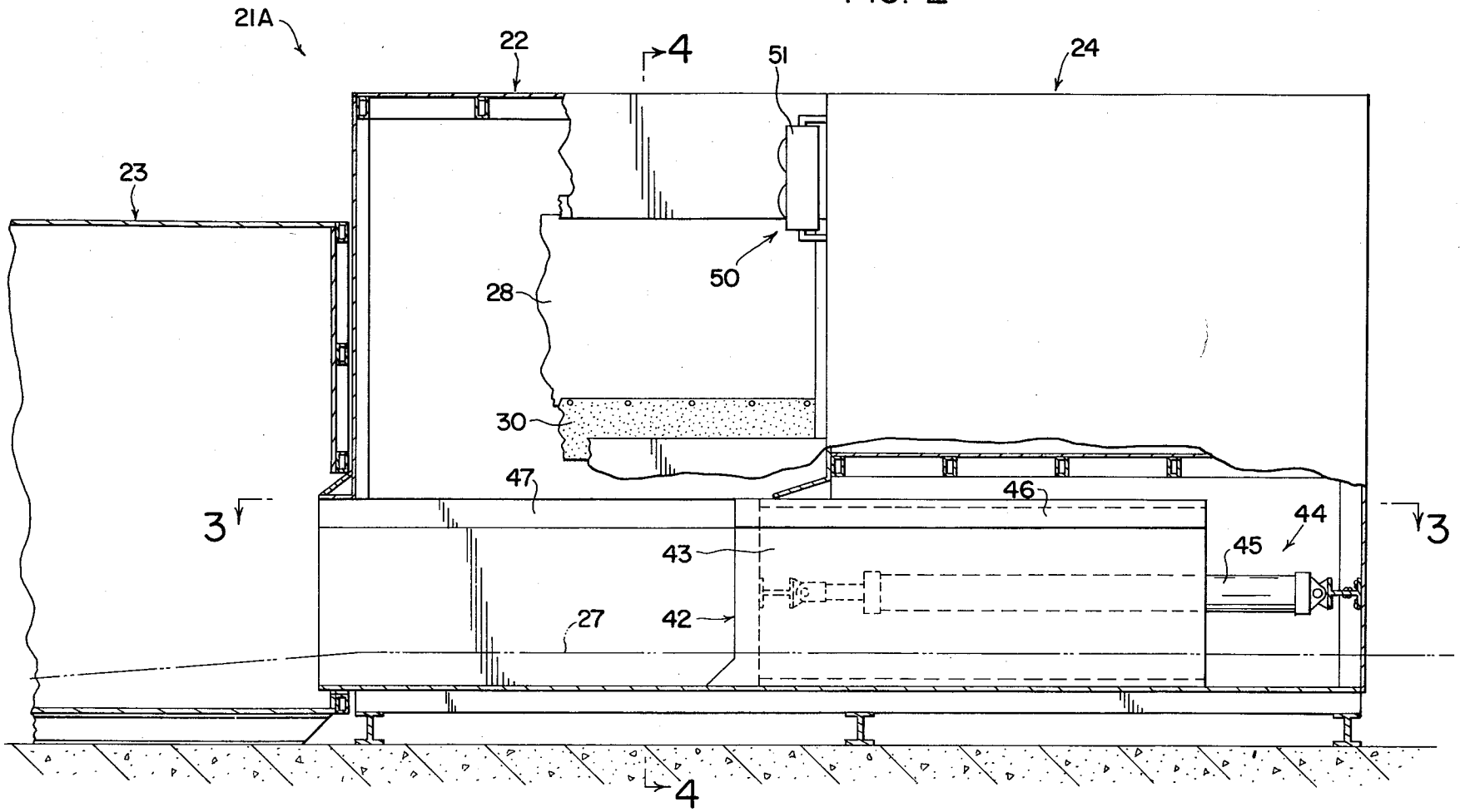
FIg. 2 is a side elevational view of a station, partly broken away, showing the hopper, storage and compactor units.
Figure 3:
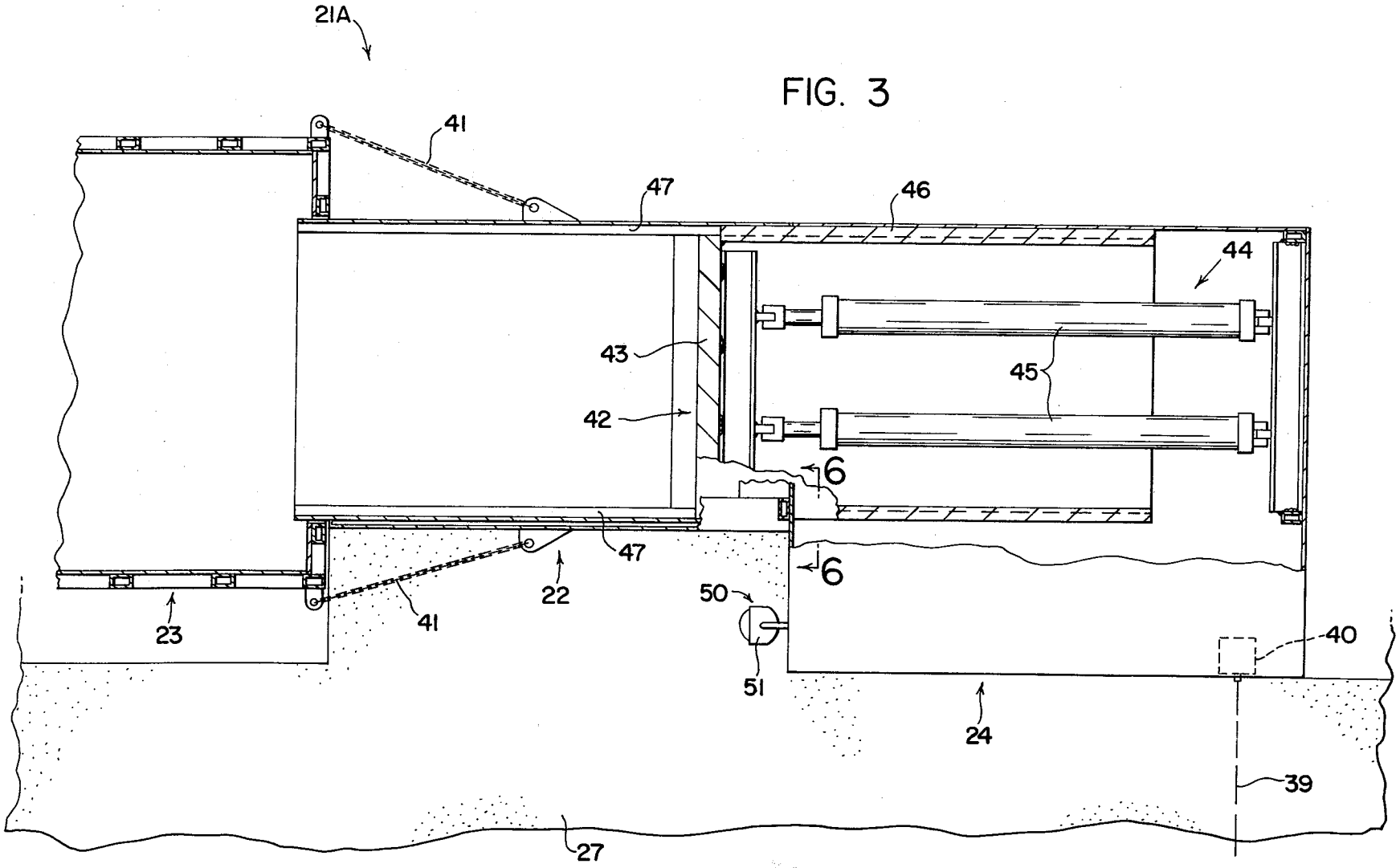
FIG. 3 is a sectional view, taken substantially as indicated along line 3—3 of FIG. 2.

As shown in FIGS. 2 and 3, a compactor unit 24 comprises a compactor means 42, which may be an elongated ram 43, reciprocally driven by suitable drive means 44, such as dual hydraulic cylinders 45. The ram 43 is adapted to traverse the hopper unit 22, and is guided therethrough as by dual ram flanges 46 slidably engaged within opposed hopper channels 47.

Referring again to FIG. 7, the lower limit switch 37 on the hopper unit 22 performs a dual function. In addition to stopping the hopper door 28 in the closed position, the switch 37 triggers the operation of compactor unit 24.

The lower limit switch 37 is connected to a compactor control means 48 by suitable circuitry so as to actuate the compactor unit 24 upon engagement of the switch 37 by the finger 34. The ram 43 is thereby caused to reciprocate through the hopper unit 22. The compacting cycle is timed, and the ram 43 is actuated for a predetermined period of time, permitting waste to be transferred to a storage unit 23, while preventing continuous reciprocation of the ram 43.

The compactor control means 48 may be adapted to permit completion of a commenced stroke of the cylinders 45 at the end of the timed compacting cycle, so as to stop the ram 43 in a retracted or rearward position, leaving the hopper unit 22 empty and in a condition for receiving additional waste.

Similarly, upon re-interruption of the signal 39 before completion of the timed compacting cycle, the ram 43 is permitted to complete the stroke in progress at the instant of engagement of the upper limit switch 35 by the finger 34, before coming to rest in the retracted position.

As waste accumulates in the storage unit 23, the waste is compacted to an increasing density. The ram 43 accordingly meets with increased resistance in traversing the hopper unit 22.

Associated with a compactor unit 24 is a detector means 25 for determining when a storage unit 23 is packed with waste having reached a predetermined density. As shown, the detector means 25 may be a pressure switch 49 to detect the increased pressure in the hydraulic fluid driving the ram 43.

Adjoining stations 21 are operatively interconnected by suitable circuitry, including a station selector means or switchover device 26. The selector means 26 is responsive to the detector means 25. When the waste in a storage unit 23 is packed to a predetermined density, the detector means 25 actuates the station selector means 26. Upon completion of the timed cycle of the compactor unit 24, the packed station 21 is thereby deactivated and an adjoining station 21 having an empty storage unit 23 will subsequently be responsive to the sensor means 38.

Each station 21 has a signal means 50, which may be a light 51, to indicate which station 21 is activated for use. As shown in FIGS. 4 and 5, the light 51 is similar to a traffic signal, with green indicating activation and red indicating deactivation.

A conventional transmitting means 52 is provided each station 21 to signal the need for emptying a packed storage unit 23.

The operation of a waste handling system 20 according to the invention is best described with reference to FIGS. 1 and 7.

As a vehicle (not shown) approaches the system 20, a signal means 50 will indicate which station 21, in this case 21A, is activated for use. The vehicle proceeds along the access road 27 until the ultrasonic signal 39 is interrupted, triggering the cycle of operation. When the signal 39 has been interrupted for a predetermined period of time, the hopper control means 33 is actuated. The hopper door 28 swings open until the finger 34 engages the upper limit switch 35. Waste is then deposited in the exposed empty hopper unit 22.

Upon departure of the vehicle, the ultrasonic signal 39 is restored, again actuating the hopper control means 33. The door 28 swings downwardly until the finger 34 engages the lower limit switch 37, triggering the compactor unit 24.

The compactor control means 48 is actuated, and the ram 43 traverses the hopper unit 22, transferring the deposited waste to the storage unit 23 and compacting the accumulated waste to an increasingly high density. The compactor unit 24 is actuated for a predetermined period of time, completing the cycle of operation.

The cycle may be repeated until the detector means 25 determines that the storage unit 23 of station 21A is packed. The station selector means 26 is then actuated to deactivate station 21A upon completion of the cycle, and to activate adjoining station 21B, having an empty storage unit 23.

The signal means 50 of station 21A will turn red and that of station 21B will turn green, reflecting the switchover. The transmitting means 52 associated with deactivated station 21A will signal the need for emptying the packed storage unit 23.

ALTERNATIVE EMBODIMENT

Figure 8:
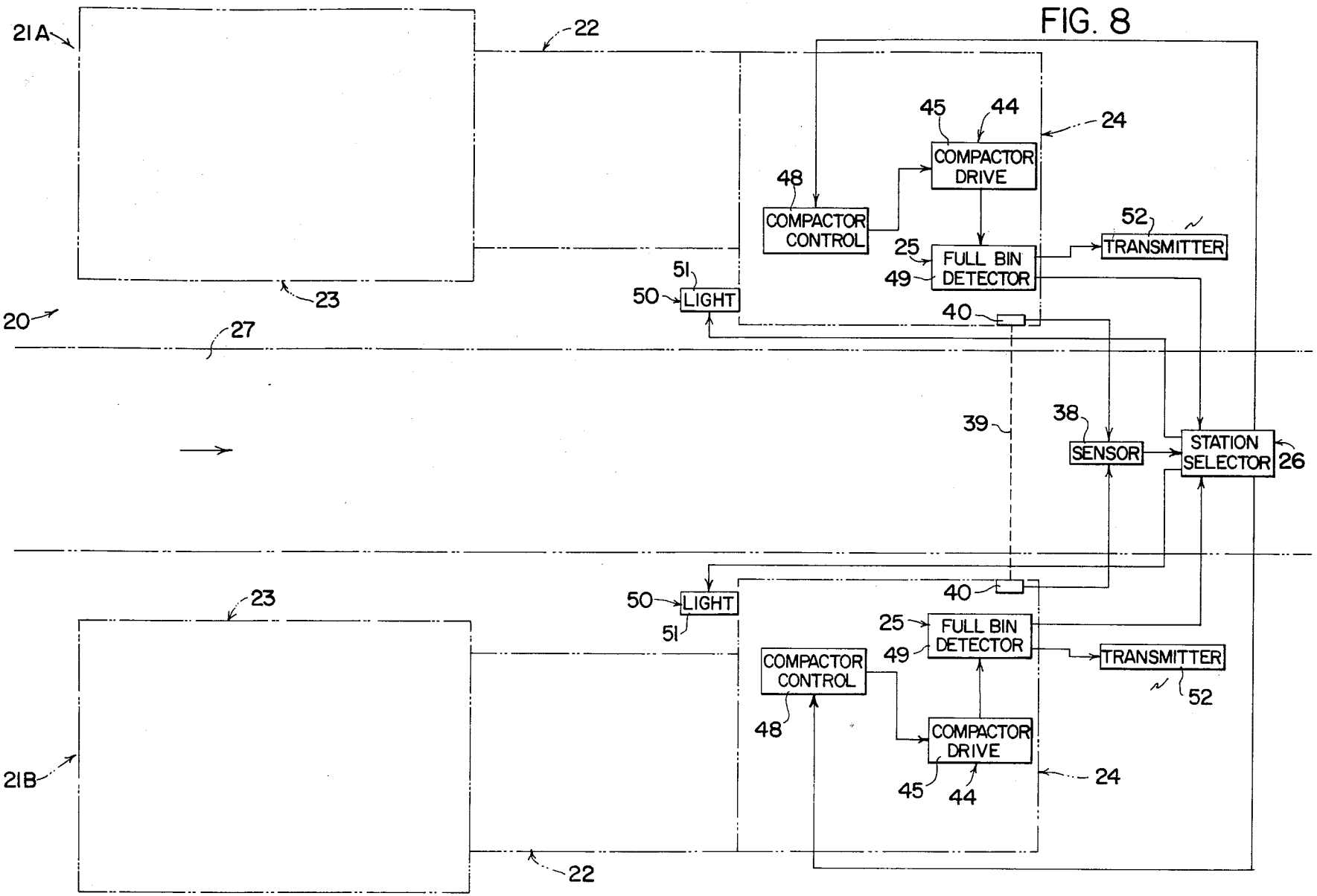
FIG. 8 is a schematic operational diagram of an alternative embodiment of the invention.

Referring to FIG. 8, in the embodiment wherein a hopper unit is a passive mechanical structure, the system 20 operates independently of a hopper control means and associated system components (reference numerals 28–37, inclusive). A hopper unit 22 is a mere box-like receptacle, the top portion of which is open.

Whereas in the preferred embodiment, the compactor control means 48 is directly responsive to a chain of events triggered by the hopper control means 33, and responsive only indirectly to the sensor means 38, in this embodiment, the compactor control means 48 is directly responsive to the sensor means 38.

The compactor control means 48 is deactuated in response to an interruption of the sensor signal 39. The compactor unit 24 may be said to be in a state or condition of "readiness," analogous to the situation in the preferred embodiment wherein the hopper door 28 is open.

Upon restoration of the sensor signal 39, the compactor control means 48 is placed in a condition of "actuation," analogous to the situation in the preferred embodiment wherein the hopper door 28 is closed. The compactor means 42 is thereby caused to reciprocally traverse the hopper unit 22 for a predetermined period of time, completing the cycle of operation.

A system 20 according to the alternative embodiment is intended to function in all other respects as described above with reference to a preferred embodiment.

What is claimed is:

1. A solid waste handling system having multiple and operatively interconnected stations, each said station having a hopper unit with an opening in a side thereof for receiving such waste, a removable storage unit for such waste, and a compactor unit having a reciprocally driven compactor means, for transferring such waste from said hopper unit and compacting such waste in said storage unit, and an associated control means for actuating said compactor means, each said hopper unit having a door pivotally mounted for opening and closing movement relative to said side opening therein and an associated hopper unit control means for actuating said movement of said door, the mounting of said door including a projection oscillating between an upper position when said door is open and a down position when said door is closed, each said hopper unit further having (1) an upper limit switch operatively connected with said hopper unit control means and positioned for engagement with said mounting projection when in said upper position whereby opening movement of said door is stopped, and (2) a lower limit switch operatively connected with said hopper unit control means and said compactor unit control means and positioned for engagement with said mounting projection when in said lower position whereby closing movement of said door is stopped and said compactor means is reciprocated through said hopper unit, each said compactor unit having associated therewith a detector means responsive to the density of such accumulated waste in each said storage unit for detecting when said storage unit is packed with such waste having reached a predetermined density, there being a station selector means in said operative interconnection between said stations, said selector means being responsive to a signal generated by one of said compactor unit detector means when a storage unit associated therewith has been packed with such waste having a predetermined density.

2. A system according to claim 1 having a sensor means capable of determining the presence of a vehicle adjacent one of said hopper units and actuating said hopper unit control means associated therewith to open said door.

3. A system according to claim 2 wherein said stations are arranged in parallel pairs symmetrical about a common access road for said vehicle.

4. A system according to claim 2 wherein the free edge of said door has secured thereto a yieldable flap.

* * * * *